US005711226A

United States Patent [19]

Harry et al.

[11] Patent Number: 5,711,226

[45] Date of Patent: Jan. 27, 1998

[54] PRINTING METHOD AND APPARATUS

[75] Inventors: Alan John Harry; Laurence John Robinson, both of Nr. Royston; Kenneth West Hutt, Wix; Richard Anthony Hann, Ipswich, all of Great Britain

[73] Assignee: Imperial Chemical Industries PLC, London, England

[21] Appl. No.: 811,182

[22] Filed: Mar. 4, 1997

Related U.S. Application Data

[63] Continuation of Ser. No. 397,136, filed as filed as PCT/GB93/01916 Sep. 10, 1993 published as WO94/06635 Mar. 31, 1994, abandoned.

[30] Foreign Application Priority Data

Sep. 11, 1992 [GB] United Kingdom ..... 9219240

[51] Int. Cl.[6] ..... B41L 35/14

[52] U.S. Cl. ..... 101/488; 347/225

[58] Field of Search ..... 101/487, 488, 101/489; 400/120.1; 347/224, 225, 241, 242, 245, 171

[56] References Cited

U.S. PATENT DOCUMENTS

| | | | |
|---|---|---|---|
| 4,369,451 | 1/1983 | Sekido et al. | 347/225 |
| 4,739,338 | 4/1988 | Tanaka et al. | 400/241.1 |
| 5,053,789 | 10/1991 | Fujii et al. | 347/171 |
| 5,087,929 | 2/1992 | Takanashi et al. | 347/225 |
| 5,142,517 | 8/1992 | Takahashi | 369/44.34 |
| 5,420,611 | 5/1995 | Sarraf | 347/215 |

FOREIGN PATENT DOCUMENTS

| | | | |
|---|---|---|---|
| 0 029 313 | 5/1981 | European Pat. Off. . | |
| 3-26595 | 2/1991 | Japan . | |
| 5-69564 | 3/1993 | Japan | 347/225 |
| 1284266 | 8/1972 | United Kingdom . | |

*Primary Examiner*—Ren Yan
*Attorney, Agent, or Firm*—Alix, Yale & Ristas, LLP

[57] ABSTRACT

Printing methods and apparatus for thermal transferring dye from a dye donor to a dye receiver wherein electromagnetic radiation such as a laser beam is applied through the dye receiver to effect dye transfer. Either or both of the dye donor and the dye receiver used with such printing methods and apparatus can be in the form of individual sheets or continuous ribbons and may be either stationary or moving. In various embodiments, the dye receiver is held between a convex surface of a rigid support plate and the dye donor during thermal transfer of dye. A variety of methods and devices for providing electromagnetic radiation and for transporting dye donors and dye receivers during printing are also disclosed.

16 Claims, 3 Drawing Sheets

PRINTING METHOD AND APPARATUS

This is a continuation of application Ser. No. 08/397,136 filed as PCT/GB93/01916 Sep. 10, 1993 published as WO94/06635 Mar. 31, 1994, now abandoned.

BACKGROUND OF THE INVENTION

The present invention relates to a printing method and apparatus involving the thermal transfer of a dye from a donor to a receiver, including melt, diffusion and sublimation transfer, and especially, but not exclusively, to such a method and apparatus employing a laser as the thermal source. The term "dye" should be taken to cover dyes, inks and pigments.

DESCRIPTION OF THE RELATED ART

In a known type of thermal printer, a dyesheet and receiver sheet are held against one another, with the dyesheet between the receiver sheet and a laser source. The printer receives signals from, for example, video equipment, an electronic still camera or a computer, and controls the laser source accordingly to heat selected individual pixel areas of the dyesheet. This causes dye in the selected areas to transfer to the receiver sheet and form a desired print pattern.

Commonly, the receiver sheet will comprise a substrate on which is mounted a layer of dye-receptive material, and the dyesheet will comprise a thin substrate supporting a dye donor layer and a laser light absorber layer, with the dye donor layer consisting of a thermally-transferable dye held in a polymeric binder and with the absorber layer comprising carbon black as a broad band absorber, or an absorber which absorbs at the particular wavelength of the laser. As an alternative, a single combined donor and absorber layer may be used.

Additional coatings may be provided on the dyesheet, such as an adhesive subbing layer between the substrate and dye donor/absorber layers. Other coatings may comprise backing layers, mounted on the opposite side of the substrate from the donor layer, for improving the heat resistance, slip and handling properties of the dyesheet. These backings are particularly useful where the dyesheet is wound in a roll, and may tend to stick to itself.

It is necessary for these additional coatings and the dyesheet substrate to be transparent to the laser radiation as, otherwise, little or no radiation would pass through to the absorber, insufficient heating would occur, and no dye transfer would take place.

This restriction on the dyesheet materials can be problematic, as a balance must be struck between the transparency of the materials and their handling and other properties. Therefore, either or both the transparency and handling characteristics of the dyesheet are less than optimum, which means that the energy efficiency and speed of the printer and/or the ease of use of the dyesheet is reduced.

SUMMARY OF THE INVENTION

It is one object of the present invention to provide a printing apparatus and method which, amongst other advantages, overcomes the above problem.

Viewed from a first aspect, the present invention provides a printing method comprising the thermal transfer of dye from a donor to a receiver, wherein the donor is heated through the receiver.

Preferably, electromagnetic radiation is used to heat a radiation absorber in the donor to cause the dye to be thermally transferred, wherein the radiation is passed through the receiver to the absorber.

As in the prior art, the donor and receiver may be in the form of sheets or ribbons held in close proximity to one another, although they could take any other suitable form, and the absorber may, amongst other arrangements, take the form of a layer on the donor sheet/ribbon either adjacent to or as part of the dye donor layer.

The invention reverses the prior art arrangements in which for example a laser beam passes through the donor and, instead, passes the radiation through the receiver. An important advantage of this is to remove the restriction on the donor sheet or ribbon that it have good radiation transmissive properties. The donor sheet or ribbon may therefore be provided with back coatings made of materials able to give optimal handling, slip and heat-resistant properties, etc, and which may be made as thick as desired to increase the donor's toughness and durability.

A further important, and separate, advantage of the invention is that printing speed in diffusion and sublimation transfer can be increased. Thus, the invention is particularly applicable to diffusion and sublimation transfer. In the known systems, the radiation impinges firstly on the side of the radiation absorber layer which is remote from the receiver. This means that heat is initially dissipated in a region of the donor which is spaced somewhat from the receiver and this slows down the initial rate of transfer of dye from the donor to the receiver. This problem may be more significant where the dye and absorber are combined into a single layer, as the thickness of such a layer may, in some cases, be increased as compared with a separate absorber layer. In accordance with the invention, however, the problem is avoided in that the radiation (having passed through the receiver) initially impinges on the side of the absorber layer which is closest to the receiver, whereby the initial rate of dye transfer and hence the printing speed are increased. This leads to a more efficient system as compared with the prior art configurations.

The invention requires the receiver to be sufficiently transparent to the radiation to enable the absorber to be heated satisfactorily. It is further preferable for the receiver to be transparent to visible light, so that the printed pattern may be viewed from the opposite side to that on which it was printed. A reason for this is that due to the radiation passing through the receiver, the print pattern resulting from the dye transfer may be the mirror image of that defined by the laser beam or beams when viewed from the side of the receiver onto which the dye is transferred, and so, to compensate for this when the receiver is opaque to visible light, the beam or beams may need to be controlled to heat the donor in a pattern which is the mirror image of that required. If the receiver is transparent to visible light, however, then no reversal need be made, as the pattern may be viewed through the opposite side of the receiver from that on to which the dye is transferred. No reversal is needed either of images for slide projection, as in this case it is the mirror image which is required.

The invention is especially applicable to printing on slide transparencies (e.g. 35 mm), microfiche, for example used in the archiving of documents, and acetate and polyester films, for example used as overhead projector transparencies.

The handling properties of the receiver are often of most importance after printing, and the receiver may be mounted on other surfaces, which need not be transparent to the thermal source, to improve these handling properties once the dye transfer is complete. (Indeed the receiver could be mounted on such surfaces before printing, and peeled off prior to or during dye transfer). In contrast, it is the handling properties of the donor prior to and during dye transfer that are important, and these can be improved by the present invention.

A further problem which may be overcome is that if transparent receivers, such as microfiche, were to be printed upon using the prior art apparatus, then the laser light could pass straight through both the donor and receiver, and pose a health hazard and a danger to eyesight. The present invention, however, allows the donor to be provided with a layer, such as an opaque-radiation absorbing layer, which prevents radiation not absorbed in the dye transfer process from passing through, and removes any health risks, to provide an inherently safer system.

In a preferred form of the invention, in which an electromagnetic radiation source especially a laser source is used, there may be a deliberate optical misalignment of the system. This reduces any feedback (e.g. reflection of a laser beam back toward the laser) of, for example, a laser beam from any uncoated partially reflective surfaces which may exist on the receiver or support member. Such optical misalignment may be achieved by slightly misaligning one or more surfaces in the path of the laser beam so that the laser beam is not perpendicular to at least one surface at the point of incidence therebetween. Alternatively, feedback can be reduced by slightly tilting the scanning mirror. Either as an alternative, or as a complement, to optical misalignment, feedback can also be reduced by defocussing the beam and/or by coating at least one of the surfaces in the path of the beam with an anti-reflection coating.

In most thermal transfer printing apparatus the donor and receiver are held closely adjacent one another during exposure to the radiation, and there are a number of known ways of achieving this in which the donor and receiver may take the form of individual sheets or continuous ribbons, and may be stationary or moving. A further advantage of the present invention is that it enables new and advantageous arrangements for supporting the donor and receiver to be employed, which are simple in construction, inexpensive, and easy to use.

In one form of the invention, the donor and receiver both comprise moving ribbons which are passed one above the other around a tensioning element, such as a roller. The roller holds the ribbons together and a radiation source is provided on the opposite side of the ribbons to the roller to effect dye transfer where the ribbons meet. In a prior art system of this type, the receiver would be adjacent the roller, with the donor facing the laser. This means that changing the receiver ribbon can be an awkward and time consuming process which may involve having to remove or at least slacken off the donor ribbon.

By the present invention, however, it is the donor ribbon which is nearest to the roller, and this enables the receiver ribbon to be much more easily removed from or inserted into apparatus for carrying out the present method. In a variation of the tensioning element, the roller could be replaced by a plate convex to the ribbons to allow them to be tensioned against it without snagging.

In another form of the invention, the receiver and donor, whether in the form of continuous ribbons or individual sheets, are held against a rigid support plate, with the receiver sandwiched between the donor and the support plate, the support plate allowing radiation to pass therethrough to effect dye transfer. This provides for a number of advantageous arrangements.

In one embodiment, the receiver may move across the plate, and the plate need only transmit radiation in a narrow region in which the receiver and donor contact one another, dye transfer then occurring on a line-by-line basis as the receiver and donor pass across this region. This may be achieved by the plate being transparent to the radiation or by having an aperture in this region, although there is no reason, of course, why the plate could not be transparent over its whole surface, or have further such regions for allowing more than one point at which dye transfer takes place.

In a preferred embodiment, where the receiver moves along a plate during dye transfer, and is in the form of a sheet, the donor is a ribbon, supply and take-up spools for which are mounted on the opposite side of the support plate from the radiation source, and a pressure pad, such as a roller, is used to urge the donor ribbon and receiver sheet against one another and against the transmissive region of the support plate. This system has certain advantages; for example, the friction acting on the donor ribbon and receiver sheet is small, the roller feeds the receiver sheet through the system, and the radiation source, for example a laser, is mounted by itself on the opposite side of the plate from the rest of the apparatus, which provides for a simple and accessible construction. In a variation, the roller could be replaced by a fixed pressure pad, which may be convex to the plate to guide the ribbon and prevent snagging, but this would increase friction and necessitate further feed means for the receiver.

The above embodiments may advantageously be used in monochrome printing, but may also be used in colour printing, in which, for example, cyan, magenta and yellow, and sometimes black, prints are superimposed over one another to give a colour print. Such colour printing however requires the receiver to be registered accurately in the same position for each cyan, magenta, yellow and black print, and it can be difficult to position a moving receiver ribbon or sheet at its original position prior to each print run, and to move it past a radiation source so that a new print is in accurate registration with those already made. In a colour printing system it is advantageous, therefore, for the receiver to remain stationary throughout each print, and for the radiation source to scan across the receiver surface. This can be readily achieved in accordance with the invention by holding the receiver against a support plate transparent to the thermal source during printing, so that the receiver remains fixed in position on the plate. Different donor sheets may then be substituted, or a donor ribbon of sequential dye strips wound on, to provide a different coloured dye for each successive print, as required, without disturbing the receiver, which remains in position and does not need to be re-registered.

The receiver may also take the form of a sheet or ribbon, and may be mounted on the support plate in a suitable manner, such as by clamping or a vacuum acting on the receiver through apertures in the plate surface. Further, the support plate need not be stationary, but may move across the radiation source during dye transfer. Accurate registration is then still needed, but it is in many cases easier to accurately re-register and control the movement of a solid support plate than a ribbon or sheet.

Where a receiver sheet is scanned by one or more radiation beams across its width and/or along its length, expensive and cumbersome flat field optics are usually required to correct for the fact that the beam focus scans in an arc, whereas the receiver is flat at the scanning point. To avoid or reduce the need for flat field optics, it is known to provide a concave support which holds the donor and receiver in the curved focal plane of the laser beam in one or more scan directions. This avoids the need for flat field optics completely or only requires correction in one dimension.

Prior art systems of this sort are not however particularly satisfactory. Generally, donor and receiver sheets are drawn into a concave recess of the support by suction means, with the donor sheet overlying the receiver sheet and facing the radiation source as is required in known arrangements. Such an arrangement is relatively complicated, and does not lend itself readily to donor sheets with different dye colours being used successively over a single receiver sheet, or to winding on a donor sheet to a new dye strip, as the suction means needs to be de-activated and re-activated each time the donor sheet is changed, and the receiver must, in each case, be displaced and then re-registered.

By the present invention, however, a receiver sheet or ribbon may be mounted on a convex surface of a support plate with a donor sheet or ribbon held thereon. By suitably configuring the convex surface, the receiver and donor sheets/ribbons may be arranged to lie in the focal plane of the laser beam in one or more of its scan directions, so that the radiation may be focused into the plane of the sheets through the plate, and, because the donor is above the receiver, the donor may be easily moved into and out of engagement with the receiver before and after each print run, without needing to move the receiver. This means that no re-registering of the receiver is needed in colour printing. The mounting of the receiver on a convex surface is also advantageous in monochrome printing.

The donor may be held against the receiver in any suitable manner such as by a vacuum or a pressure pad having a concave surface corresponding to the convex surface of the plate, but in a preferred form, the donor is held in tension around the convex surface and may take the form of a ribbon.

The donor ribbon may be wound on spools, optionally housed in a cartridge or cassette, the spools being movable either side of the support plate in order to place the ribbon into and out of tension about the plate. To form each colour print, the donor ribbon may be moved out of contact from the receiver, wound on, and retensioned around the curved support plate and back into contact with the fixed receiver.

The receiver, too, may be a ribbon held under tension around the convex surface of the support plate, or may be mounted to the support plate by adhesive or a vacuum, or in any other suitable manner, such as by being clamped at its edges.

In a further embodiment, the curved support may be driven to move in a circle or backwards and forwards in an arc, and may, as a result, engage with and disengage from a donor ribbon at the start and end of each print. This may be through friction or a more positive engagement, and on each engagement the donor ribbon may be moved forward by, for example, one colour strip. This may remove the need for a donor ribbon spool drive.

Where the support is arranged to move, the radiation source may not need to scan in one or more directions.

A point to note in relation to the present invention and colour printing is that, as the thermal radiation passes through the receiver, it may pass through dye already transferred to the receiver by a prior print run. Preferably, therefore, the dyes themselves are transparent to the thermal radiation, or different colour dyes are transparent to different thermal radiation wavelengths and separate thermal sources having corresponding wavelengths are used to transfer each dye respectively. This helps to prevent a print already formed from being degraded by the thermal radiation, and also reduces back diffusion of the dyes into the dye donor or ribbon. In addition, or as an alternative to this, the thermal source may be activated to compensate for effects of this type during each successive print.

The radiation may be altered or diverted during its passage though the receiver, and optics may be provided to correct for this prior to the radiation entering the receiver. For example, optics may be provided to correct for bi-refringence, although, in this case, the radiation could be polarised before entering the receiver, or an inherently polarised source such as a laser diode could be used.

The invention may also extend to apparatus for carrying out any of the above methods. Thus, viewed from a further aspect, the invention provides thermal transfer printing apparatus comprising means for supporting a dye donor medium and a receiver medium, such as sheets or ribbons, in close proximity to one another, and a thermal source arranged to provide preferably electromagnetic radiation which, in use, passes through the receiver and thereby into the donor.

The dye donor medium is preferably also a sheet or ribbon, and the preferred apparatus comprises a transparent receiver support plate. The plate is curved in one embodiment, and the apparatus may further comprise means for holding a donor ribbon in tension on the convex side of the plate.

The preferred thermal radiation source is a laser, such as a laser diode or array of diodes.

BRIEF DESCRIPTION OF THE DRAWINGS

Embodiments of the present invention will now be described, by way of example only, with reference to the accompanying drawings, in which.

DESCRIPTION OF THE PREFERRED EMBODIMENTS

Figure 1:
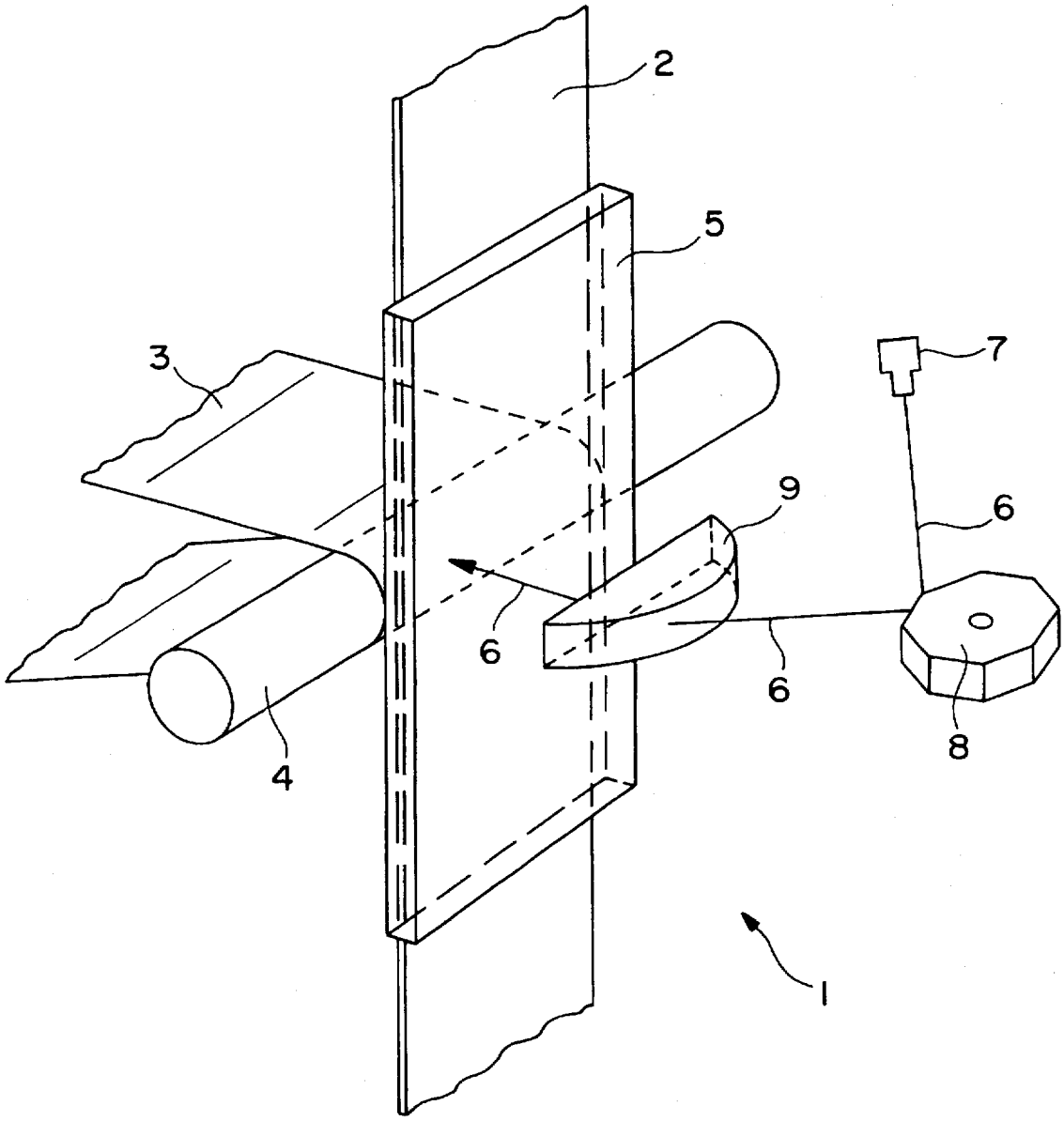
FIG. 1 is a perspective view of a dye thermal transfer system according to a first embodiment of the present invention.

Referring to FIG. 1, a dye thermal transfer printing apparatus 1 is shown, in which a receiver 2, in the form of a sheet, and a dye donor 3, in the form of a ribbon mounted on spools (not shown), are fed between the nip of a pressure roller 4 and a support plate The support plate 5 and receiver sheet 2 are transparent to the light of a laser beam 6 from a laser source 7, such as a Nd:YAG laser or a laser diode array, and a rotating polygon 8 is used to scan the beam 6 across the width of the donor ribbon 3 at the point where the receiver sheet 2 and donor ribbon 3 are pressed together. A flat field lens 9 is provided between the polygon 8 and support plate 5 to modify the laser beam 6 to scan in a flat focal plane rather than a curved one.

The power of the laser beam 6 is modulated as it scans across the donor ribbon 3 in order to heat selected pixel areas of the ribbon 3 to a greater or lesser extent, and to therefore cause more or less dye to be transferred to the receiver sheet 2. A print image is thus built up line-by-line as the receiver sheet 2 and donor ribbon 3 are fed past the roller 4. Modulation of the laser power output may be under microprocessor control as is well known in the art.

Carrying out this procedure will produce a monochrome print, but a colour print may be produced by repeating the procedure three or four times, each time with a different dye, e.g. cyan, magenta, yellow and possibly black. To do this a different dye donor ribbon 3 may be used each time, or the ribbon 3 may have successive strips of differently coloured dyes, so that it need only be wound onto the next strip.

As a variation on the above embodiment, a linear array of separately modulated laser beam sources could be arranged across the width of the dye donor ribbon 3, below the support plate 5, to replace the beam scanning. Also, the support plate 5, which need only be transparent in the region opposing the roller 4, could instead have a slot therein through which the laser beam 6 may pass.

Figure 2:
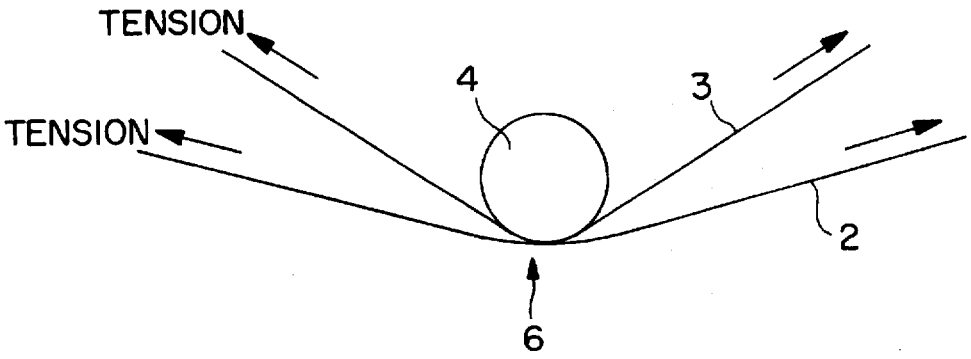
FIG. 2 is a schematic front elevation of a second embodiment of the present invention.

FIG. 2 shows a second embodiment, somewhat similar to the first embodiment, but with the receiver 2 in the form of a ribbon and without a support plate 5.

The receiver 2 and dye donor 3 are urged together through tension in the ribbons, which is produced by the roller 4, and a scanning laser beam or an array of individual beams are directed through the receiver ribbon 2 and on to the dye donor ribbon 3, as described above.

As a variation on this embodiment, a stationary support plate, convex to the laser source to aid in guiding and prevent snagging of the ribbons, could be used instead of the roller 4, although this then produces more friction.

Figure 3:
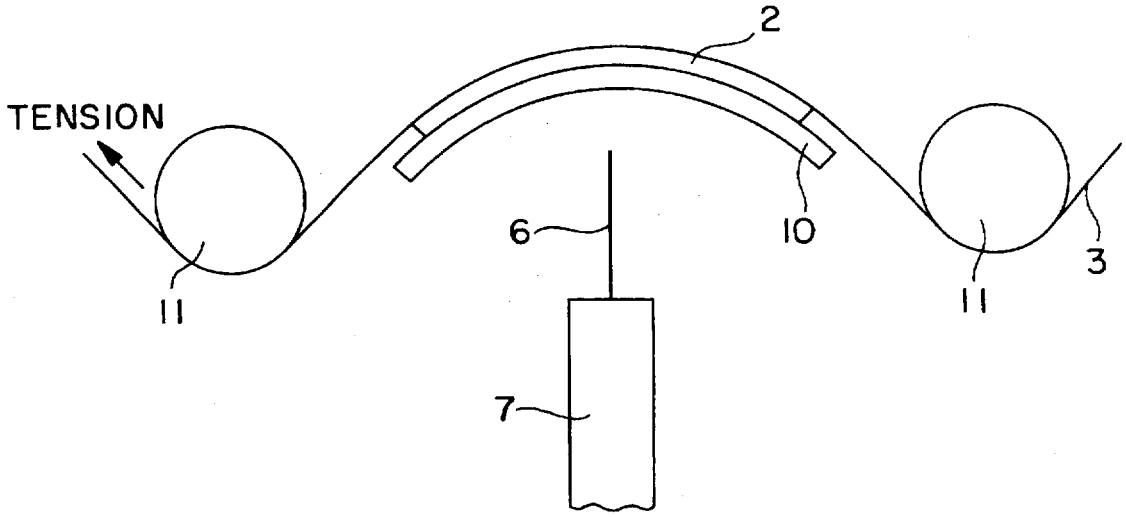
FIG. 3 is a schematic front elevation of a dye thermal transfer system according to a third embodiment of the present invention.

FIG. 3 shows a third embodiment of the present invention, in which the receiver 2, in the form of a sheet, and the dye donor 3, in the form of a ribbon, engage upon a curved support plate 10 concave to the radiation source.

The receiver 2 is fixed in position on the support plate 10 by, for example, an edge clamp, and the dye donor ribbon 3 is held in place through tension. This tension may be applied by moving a pair of rollers 11 from a position above the support plate 10 to a position on either side of it, in which they urge the donor ribbon 3 downwardly into contact with the support plate 10 and receiver sheet 2, and into tension about them. The donor ribbon 3 may, for example, be housed in a cassette or cartridge, and the rollers 11 housed in a main printing apparatus body, to be located behind the ribbon 3 on insertion of the cassette or cartridge into the body. A modulated laser beam 6 is passed through the support plate 10 and receiver ribbon 2 and may scan across the dye donor ribbon 3 to cause dye transfer. The support plate 10 is curved in such a manner that the laser absorber layer of the dye donor ribbon 3 lies in the scanning plane of the laser beam, and so no flat field lens is required to modify the beam to scan in a flat plane.

Figure 4:
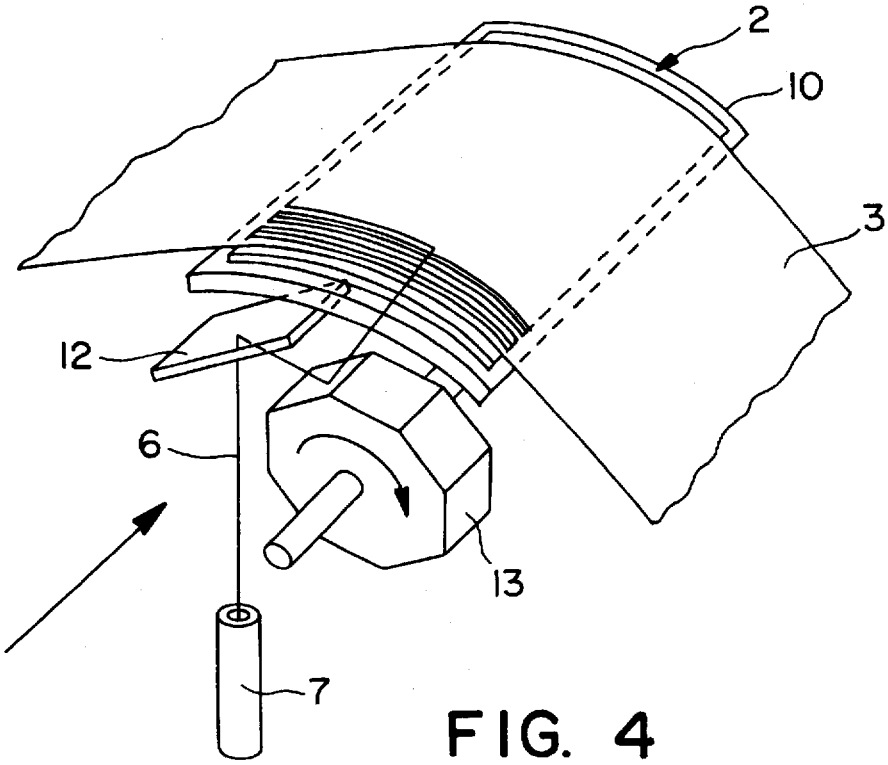
FIG. 4 is a perspective view of a possible scanning arrangement for the system of FIG. 3.

A suitable scanning system is shown in FIG. 4, in which a mirror 12 reflects the beam 6 onto a rotating polygon 13 which, in turn, scans the beam along the length of the ribbon 3. The laser source 7, mirror 12 and polygon 13 are movably together in the direction of the arrow to allow the beam 6 to scan across the width of the donor ribbon. Alternatively, the support plate 10, receiver sheet 2 and donor ribbon 3 may be moved relative to the polygon 13 to provide this scanning, or the mirror 12 may be rotatable to scan the beam 6. In the latter case, a dynamic focussing assembly would be needed between the laser source 7 and mirror 12 to compensate for the change in path length of the beam which would otherwise vary the beam's focus.

Instead of this scanning system, an array of laser beams arranged across the width of the donor ribbon 3 could be scanned together along the ribbon's length, and this could be achieved by using a scanning mirror or rotating polygon or by rotating the laser source array itself.

In this embodiment, the receiver does not move, and so re-registering is not required when producing colour prints. Instead, all that is needed is for the donor ribbon 3 to disengage from the receiver sheet 2, and be wound on so that a new colour strip is laid over the receiver 2 when the dye donor ribbon 3 is re-engaged with the receiver sheet 2.

In a variation, the receiver sheet 2 could be in the form of a ribbon held in place by tension about the curved support plate 10 or by, for example, a vacuum to which the ribbon is subjected by holes to the plate 10.

As a further variant, the laser beam is only scanned across the width of the donor ribbon 3, or, equivalently, a stationary array of laser beams are provided across the width, and the receiver 2 and curved support plate 10 are moved in an arc having a radius of curvature substantially equal to that of the support plate's curved surface. This movement thus effectively provides the scanning along the length of the dye donor ribbon 2, and by continuing the movement to engage and/or disengage the donor ribbon 3 as the support plate 10 moves in a circle or back and forth in an arc, the donor ribbon 3 may be moved on to the next colour strip after each individual print. This then may remove the need for a donor ribbon spool drive.

EXAMPLE

By passing the laser beam through the receiver, the beam initially impinges on the side of the absorber layer which is closest to the receiver and so the optical density build up rate is increased as compared with the prior art. This can be seen in the following example:

A magenta dye coat solution was made up as follows:

| | |
|---|---|
| 3-methyl-4(3-methyl-4 cyanoisothiazol-5-ylazo)-N-ethyl-N-acetoxyethyl-aniline (Magenta dye) | 0.833 g |
| Ethyl Cellulose T10 ex. Hercules | 0.111 g |
| Polyvinylbutyral (BX1) ex. Sekisui | 0.444 g |
| Hexadeca-b-thionaphthalene Copper (II) phthalocyanine (infra red absorbing dye) | 0.197 g |
| Tetrahydrofuran | 11.1 g |

This solution was then coated onto 23 μm polyester film with a K4 meyer bar and dried giving a dyecoat with a thickness of 4.5 μm. This donor ribbon was then held against a transparent receiver film comprising a dye receptive coating on transparent 120 μm polyester. Good contact between donor and receiver was maintained by holding them between a platten and nip roller. A 150 mW, 817 nm SDL laser diode was collimated and focussed using a 160 mm achromat lens, resulting in a laser spot size of 20×30 μm at the surface of the media (full width at half power maximum), and a power of 100 mW. The laser beam was scanned across the media using a galvanometer scanner, and the laser pulsed for varying lengths of time allowing a series of magenta blocks to be printed in the receiver, the optical density of each block corresponding to the laser on times used. Each individual spot making up the blocks was printed so that its centre lay 20 μm from the spots around it. The transmission optical density of each block was measured using a Sakura densitometer using a green filter. Plots of OD vs laser on time were drawn to compare the rate of OD build up when imaging either through the donor (a) or the receiver (b). These are shown in FIG. 5.

Figure 5:
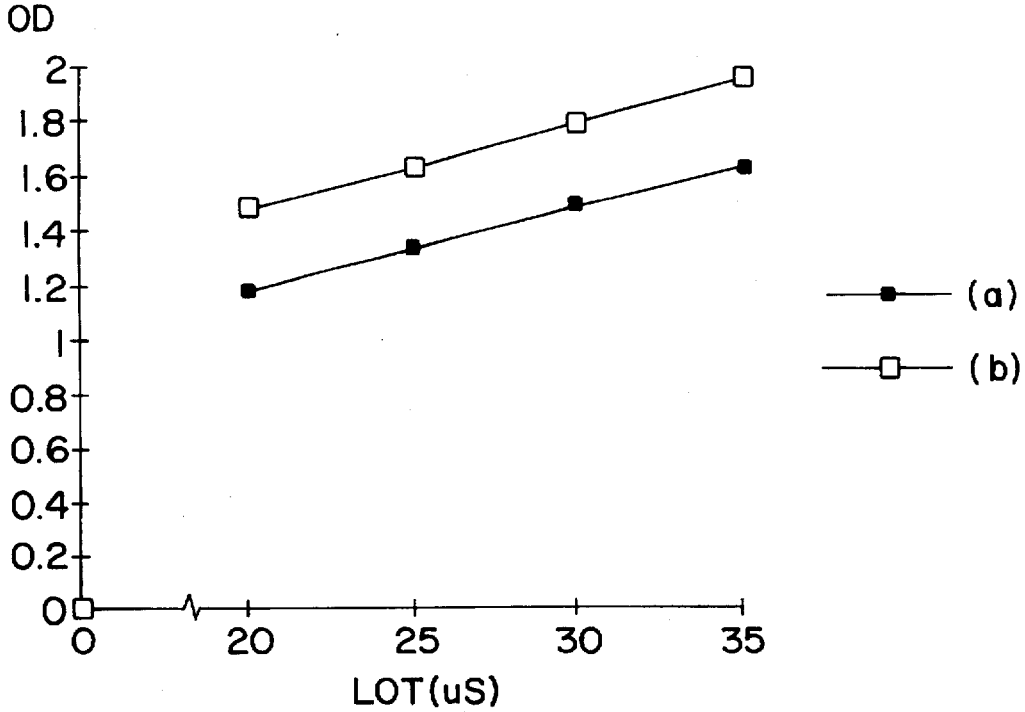
FIG. 5 shows a graph of laser-on-time against optical density on which are plotted the optical density of prints produced by imaging through (a) a donor and (b) a receiver.

Comparison of the curves in FIG. 5 shows that printing via irradiation through the receiver improves both the rate of OD build up and the OD maximum attainable.

What is claimed is:

1. A printing method comprising the steps of:

providing an electromagnetic radiation source which emits a beam of electromagnetic radiation beam having a curved focal plane;

providing an arcuate support means having a radius of curvature, a convex surface and an oppositely disposed concave surface, said arcuate support means being substantially transparent to said electromagnetic radiation, said arcuate support means being located relative to the electromagnetic radiation source such that said electromagnetic radiation emitted by the radiation source will be incident upon the concave surface of the arcuate support means;

providing a dye receiver and a dye donor on the convex surface of the arcuate support means, the dye receiver being positioned between the convex surface of the arcuate support means and the dye donor, the dye donor lying substantially in a curved focal plane of said electromagnetic radiation; and scanning said electromagnetic radiation across the arcuate support means in the direction of curvature of the arcuate support means, said electromagnetic radiation passing through the arcuate support means and the dye receiver to heat the dye donor to thereby thermally transfer dye from the dye donor to the dye receiver.

2. The printing method according to claim 1, wherein the thermal transfer of dye occurs by diffusion or sublimation.

3. The printing method according to claim 1, wherein said steps of scanning said electromagnetic radiation and of providing a dye donor and a dye receiver are cyclically repeated, and wherein said method further comprises the step of holding the dye receiver stationary on the arcuate support means.

4. The printing method according to claim 1, further comprising the step of holding the dye donor in tension about the dye receiver and the arcuate support means.

5. The printing method according to claim 1, wherein said step of providing a dye receiver and a dye donor includes providing a dye receiver which is transparent to visible light.

6. The printing method according to claim 1, wherein said step of providing a dye receiver and a dye donor includes the step of providing a dye receiver which is selected from the group consisting of a slide transparency, microfiche, an acetate film, and a polyester film.

7. The printing method according to claim 1, further comprising the step of aligning said electromagnetic radiation relative to the arcuate support means such that said electromagnetic radiation emitted by the electromagnetic radiation source is not substantially perpendicular to the support means at the point of incidence therebetween.

8. The printing method according to claim 1, further comprising the step of providing the support means with an anti-reflection coating.

9. The printing method according to claim 1, further comprising the step of defocusing said electromagnetic radiation to thereby substantially prevent feedback of said electromagnetic radiation to the electromagnetic radiation source.

10. Thermal transfer printing apparatus for use with a dye donor and a dye receiver, said apparatus comprising:

an electromagnetic radiation source for generating a beam of electromagnetic radiation;

arcuate support means having a radius of curvature, a convex surface and an oppositely disposed concave surface, said support means being substantially transparent to the electromagnetic radiation generated by said source, said support means being positioned relative to said source such that said electromagnetic radiation is incident upon said concave surface of said support means;

means for mounting a dye receiver and a dye donor on said convex surface of said arcuate support means with the dye receiver being disposed between said convex surface and the dye donor, said mounting means locating the dye donor substantially in a curved focal plane of the electromagnetic radiation generated by said radiation source; and means for scanning said beam of electromagnetic radiation across said arcuate support means in the direction of curvature of said arcuate support means whereby said electromagnetic radiation will pass through said arcuate support means and the dye receiver to heat the dye donor to thereby thermally transfer dye from the dye donor to the dye receiver.

11. The thermal transfer printing apparatus of claim 10, further comprising means for holding the dye donor in tension about the dye receiver and said arcuate support means.

12. The thermal transfer printing apparatus of claim 10, further comprising:

means for successively placing additional dye donors adjacent a mounted dye receiver to successively transfer dye from the additional dye donors to a dye receiver upon successively scanning said electromagnetic radiation through said arcuate support means and the dye receiver; and means for holding the dye receiver in place on said convex surface of said arcuate support means.

13. The thermal printing apparatus of claim 10, wherein said transfer is by diffusion or sublimation.

14. A printing method comprising the steps of:

providing an electromagnetic radiation source which emits electromagnetic radiation;

providing an arcuate support means having a radius of curvature, a convex surface and a concave surface, said arcuate support means being substantially transparent to said electromagnetic radiation and arranged such that said electromagnetic radiation is incident upon said concave surface of said arcuate support means;

providing a dye receiver and a dye donor on said convex surface of said arcuate support means with said dye receiver disposed between said convex surface of said arcuate support means and said dye donor; and causing relative movement between said electromagnetic radiation and said arcuate support means in the direction of curvature of said arcuate support means such that the path length of said electromagnetic radiation between said electromagnetic radiation source and said dye donor remains substantially constant, said electromagnetic radiation passing through said arcuate support means and said dye receiver to heat said dye donor to thereby thermally transfer dye from said dye donor to said dye receiver.

15. Thermal transfer printing apparatus for use with a dye donor and a dye receiver, said apparatus comprising;

an electromagnetic radiation source for emitting electromagnetic radiation;

an arcuate support means having a radius of curvature, a convex surface and a concave surface, wherein said arcuate support means is substantially transparent to said electromagnetic radiation and is arranged such that said electromagnetic radiation is incident upon said concave surface of said arcuate support means, said arcuate support means being curved such that the path length between said electromagnetic radiation source and said convex surface of said arcuate support means is substantially constant; and means for mounting a dye receiver and a dye donor on said convex surface of said arcuate support means with said dye receiver between said convex surface of said support means and said dye donor, said electromagnetic radiation passing in use through said arcuate support means and said dye receiver to heat said dye donor to thereby thermally transfer dye from said dye donor to said dye receiver.

16. A printing method comprising the steps of:

providing an electromagnetic radiation source which emits electromagnetic radiation;

providing an arcuate support means having a radius of curvature, a convex surface and a concave surface, said arcuate support means being substantially transparent to said electromagnetic radiation and arranged such that said electromagnetic radiation is incident upon said concave surface of said arcuate support means;

providing a dye receiver and a dye donor on said convex surface of said arcuate support means with said dye receiver between said convex surface of said arcuate support means and said dye donor; and moving said arcuate support means in an arc relative to said electromagnetic radiation, said electromagnetic radiation passing through said arcuate support means and said dye receiver to heat said dye donor to thereby thermally transfer dye from said dye donor to said dye receiver.

* * * * *